US006909862B2

(12) United States Patent
Samei et al.

(10) Patent No.: US 6,909,862 B2
(45) Date of Patent: Jun. 21, 2005

(54) PRINTER APPARATUS HAVING FIXING UNIT WITH HEAT CONTROLLER FOR CONTROLLING TEMPERATURE OF HEAT-UP ROLLER

(75) Inventors: Masahiro Samei, Fukuoka (JP); Tomoyuki Noguchi, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 411 days.

(21) Appl. No.: 10/046,822

(22) Filed: Jan. 17, 2002

(65) Prior Publication Data

US 2002/0130945 A1 Sep. 19, 2002

(30) Foreign Application Priority Data

Jan. 19, 2001 (JP) ..... 2001-011280
Jan. 19, 2001 (JP) ..... 2001-011281

(51) Int. Cl.[7] ..... G03G 15/20

(52) U.S. Cl. ..... 399/69; 219/216; 219/510; 399/330

(58) Field of Search ..... 399/33, 69, 329, 399/330, 335; 432/35, 60, 228; 219/216, 494, 510, 512, 619, 643, 644, 660; 347/156; 361/105; 337/1, 16

(56) References Cited

U.S. PATENT DOCUMENTS

| | | | | | |
|---|---|---|---|---|---|
| 3,989,926 | A | * | 11/1976 | Yoshizawa et al. | 219/216 |
| 4,687,315 | A | * | 8/1987 | Fujii | 118/640 |
| 5,019,692 | A | * | 5/1991 | Nbedi et al. | 219/469 |
| 5,286,950 | A | * | 2/1994 | Sakata | 219/469 |
| 6,072,155 | A | * | 6/2000 | Tomatsu | 219/216 |
| 6,075,228 | A | * | 6/2000 | Goto et al. | 219/216 |
| 6,101,363 | A | * | 8/2000 | Tomatsu | 399/330 |
| 6,137,087 | A | * | 10/2000 | Tomatsu | 219/216 |
| 6,285,006 | B1 | * | 9/2001 | Hyllberg | 219/216 |
| 6,516,164 | B1 | * | 2/2003 | Kawazu | 399/69 |

FOREIGN PATENT DOCUMENTS

| | | | | | |
|---|---|---|---|---|---|
| JP | 57-161767 | | | 10/1982 | |
| JP | 63-313182 | | | 12/1988 | |
| JP | 1-263679 | | | 10/1989 | |
| JP | 2-176432 | | | 7/1990 | |
| JP | 03144681 | A | * | 6/1991 | G03G/15/20 |
| JP | 5-107980 | | | 4/1993 | |
| JP | 5-303299 | | | 11/1993 | |
| JP | 6-202524 | | | 7/1994 | |
| JP | 7-334029 | | | 12/1995 | |
| JP | 8-286539 | | | 11/1996 | |
| JP | 9-62140 | | | 3/1997 | |
| JP | 09197851 | A | * | 7/1997 | G03G/15/20 |
| JP | 10171295 | A | * | 6/1998 | G03G/15/20 |
| JP | 10-213995 | | | 8/1998 | |
| JP | 11-24492 | | | 1/1999 | |
| JP | 11-102769 | | | 4/1999 | |
| JP | 11-109774 | | | 4/1999 | |
| JP | 11-174884 | | | 7/1999 | |
| JP | 11-297462 | | | 10/1999 | |
| JP | 11327332 | A | * | 11/1999 | G03G/15/20 |
| JP | 2002214962 | A | * | 7/2002 | G03G/15/20 |
| JP | 2002214963 | A | * | 7/2002 | G03G/15/20 |

* cited by examiner

*Primary Examiner*—Robert Beatty
(74) *Attorney, Agent, or Firm*—Wenderoth, Lind & Ponack, L.L.P.

(57) ABSTRACT

Disclosed is a printer apparatus that ensures temperature control of a heat-up roller in a fixing unit thereof. An image-forming unit forms an image to be transferred onto a recording material. The fixing unit fixes the image onto the recording material. The fixing unit includes a heat-up roller, a heating section for heating the heat-up roller, a power supply section for supplying power to the heating section, and a heat controller for controlling the power supply section. The heat controller is disposed in contact with the inner circumferential surface of the heat-up roller. When heated to temperatures above a predetermined value, the heat controller is thermally deformed and leaves the inner circumferential surface of said heat-up roller to interrupt the power supply of the power supply section to the heating section.

35 Claims, 22 Drawing Sheets

PRINTER APPARATUS HAVING FIXING UNIT WITH HEAT CONTROLLER FOR CONTROLLING TEMPERATURE OF HEAT-UP ROLLER

FIELD OF THE INVENTION

The present invention relates to a printer apparatus having a fixing unit, such as a copying machine, facsimile, or printer.

BACKGROUND OF THE INVENTION

Many image-forming apparatuses such as printers have fixing units.

Such a fixing unit fixes an unfixed toner image that has been formed by an imaging process, e.g. electrophotographic, electrostatic, and magnetic recording, on recording materials, e.g. a recording sheet, sensitized paper, and electrographic paper. Fixing units known as such employ a heating roller method and a film heating method. In recent years, an image-forming apparatus having a fixing unit using an electromagnetic induction heating method is known.

A fixing unit using the film heating method is disclosed in Japanese Patent Application Non-Examined Publication No. S63-313182 or No. H01-263679, for example.

As for a fixing unit using the electromagnetic induction heating method, a technique of causing a fixing roller to produce heat resulting from magnetic induction is disclosed in Japanese Patent Application Non-Examined Publication No. H11-297462. Herein, an alternating field causes the conductive layer of the fixing roller to produce eddy current and thus Joule heat, and this Joule heat causes the fixing roller to heat.

A fixing unit using the electromagnetic induction heating method is described below.

FIG. 22 is a schematic view of a fixing unit using a conventional electromagnetic induction heating method.

In the fixing unit shown in FIG. 22, exciting coil 42 is disposed along outer circumferential surface of fixing roller 41. Magnetic substance 43 is disposed outside of and over this exiting coil 42. Pressurizing roller 44 is disposed so as to press fixing roller 41 in contact therewith. Temperature sensor 45 detects temperatures on the surface of fixing roller 41.

Alternating current at frequencies of 10 to 100 MHz is applied to exciting coil 42. The magnetic field induced by this alternating current feeds eddy current through the conductive layer of fixing roller 41, thereby causing Joule heat.

Temperature sensor 45 is disposed in contact with the front face of fixing roller 41. Responsive to signals detected by temperature sensor 45, power supply to exciting coil 42 is increased or decreased. Thus the temperatures on the front face of fixing roller 41 are automatically controlled so that a predetermined fixed value is maintained.

Recording material 46 carrying unfixed toner image 47 thereon is conveyed and placed by a carrier guide (not shown) in a position in which the recording material is guided to a nip portion "NI" between fixing roller 41 and pressurizing roller 44.

In this manner, fixing roller 41 is rotated by a driving unit (not shown). At the same time, alternating current is applied to exciting coil 42 to heat up fixing roller 41. Therefore, the fixing nip portion "NI" is heated to a predetermined temperature. In this state, recording material 46 carrying unfixed toner image 47 thereon is guided by the carrier guide (not shown) and introduced into the fixing nip portion "NI". The recording material is further conveyed as fixing roller 41 rotates, and toner image 47 is melted and fixed onto recording material 46 by the heat of fixing roller 41 and the pressure of the nip portion.

As mentioned above, a fixing unit using the electromagnetic induction heating method heats fixing roller 41 with high heat transfer by utilizing eddy current produced by electromagnetic induction. Therefore, this method has such advantages as reducing warm-up time, allowing the unit to start earlier than a fixing unit using the film heating method, and contributing to energy saving.

In Japanese Patent Application Non-Examined Publication No. H08-286539, the following structure is disclosed.

A rotating heat-producing section has a conductive layer comprising a film containing a ferromagnetic metal, e.g. nickel, iron, ferromagnetic stainless steel, and nickel-cobalt alloy. Provided inside of the rotating heat-producing section is an electromagnetic induction heating section that has exciting coils wound along a core material in the direction of the rotating shaft of the rotating heat-producing section.

A fixing unit using the electromagnetic induction heating method disclosed in Japanese Patent Application Non-Examined Publication No. H11-297462 is structured so that the unit has an electromagnetic induction heating section outside of a fixing roller and substantially half of a circumferential area of the fixing roller is locally heated. In order to prevent abnormal temperature rise in a heat-producing section resulting from uncontrollable temperature, a heat controller comprising a heat-sensitive operation section, such as a thermostat, is provided in a position opposite to the electromagnetic induction heating section, i.e. inside of a heat-up roller.

In this structure, the surface of the heat-sensitive operation section may be worn by sliding thereof resulting from the rotation of the fixing roller. Therefore, it is difficult for the heat-sensitive operation section to be pressed onto the inside of the heat-up roller in contact therewith in a stable manner.

SUMMARY OF THE INVENTION

The present invention provides a printer apparatus having a fixing unit using the electromagnetic induction heating method that allows stable detection of heat temperatures of a heat-up roller thereof.

In a printer apparatus in accordance with the present invention, an image-forming unit thereof forms an image that is to be transferred onto a recording material. The fixing unit fixes the image onto the recording material. The fixing unit has a heat-up roller, a heating section for heating the heat-up roller, a power supply section for supplying power to the heating section, and a heat controller for controlling the power supply section.

The heat controller is disposed in contact with the inner circumferential surface of the heat-up roller. When the heat controller is heated to temperatures above a predetermined value, it is thermally deformed and leaves the inner circumferential surface and thereby interrupts power supply from the power supply section to the heating section.

In the printer apparatus in accordance with the present invention, temperature control of the heat-up roller in the fixing unit is ensured in this manner.

DETAILED DESCRIPTION OF THE PREFERRED EMBODIMENTS

Exemplary embodiments of the present invention are hereinafter demonstrated with reference to the accompanying drawings.

In the following drawings, elements that perform the same operations have the same reference marks, and repetitive descriptions of those elements are omitted.

(First Embodiment)

Figure 1:
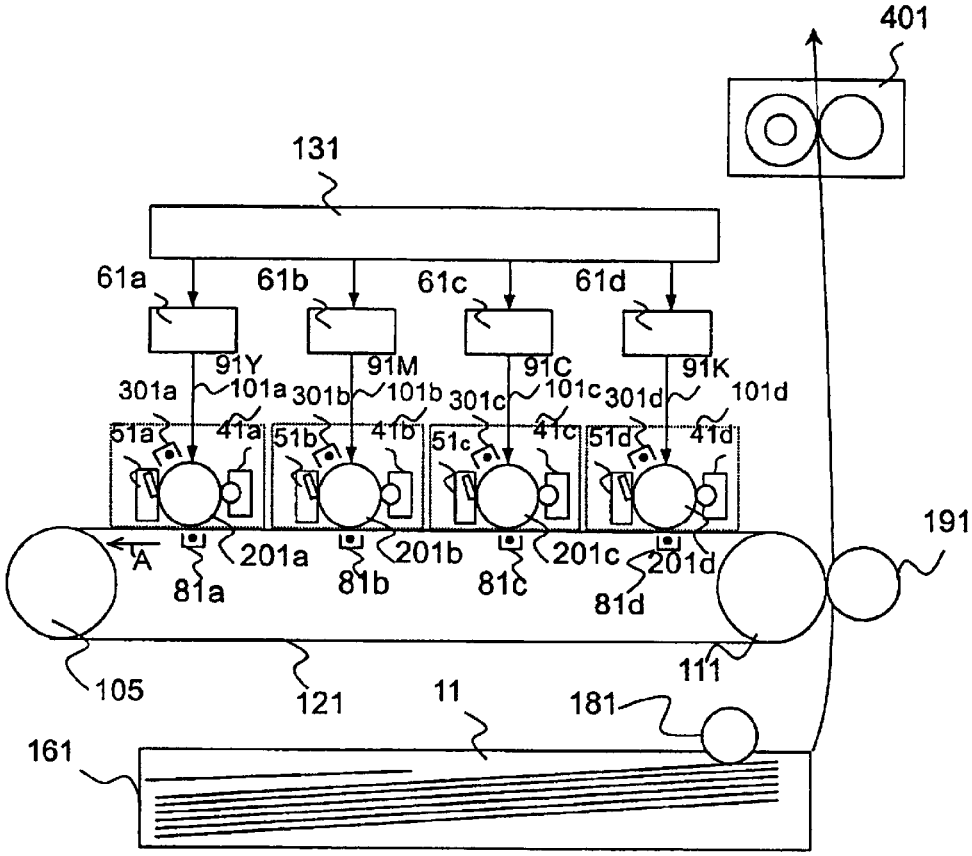
FIG. 1 illustrates an overall structure of a printer apparatus in accordance with an exemplary embodiment of the present invention.

FIG. 1 shows a structure of a printer apparatus in accordance with a first exemplary embodiment of the present invention.

In this color printer apparatus, four image-forming units 101*a*, 101*b*, 101*c*, and 101*d* are disposed. Image-forming units 101*a*, 101*b*, 101*c*, and 101*d* have photosensitive drums 201*a*, 201*b*, 201*c*, and 201*d*, respectively. A latent image is formed on each of the drums by irradiation of exposure light.

Provided in the periphery of photosensitive drums 201*a* to 201*d* are electric chargers, an exposure unit, development sections, transfer sections, and cleaning sections.

Electric chargers 301*a*, 301*b*, 301*c*, and 301*d* electrically charge the surface of each of photosensitive drums 201*a* to 201*d* to a predetermined electric potential uniformly. Exposure unit 131 irradiates charged photosensitive drums 201*a* to 201*d* with exposure light 91Y, 91M, 91C, and 91K corresponding to image data of particular colors to form electrostatic latent images. Development sections 41*a*, 41*b*, 41*c*, and 41*d* visualize the electrostatic latent images formed on photosensitive drums 201*a* to 201*d*.

Transfer sections 81*a*, 81*b*, 81*c*, and 81*d* transfer the toner images visualized on photosensitive drums 201*a* to 201*d* onto endless band-like inter-stage transfer belt 121. Cleaning sections 51*a*, 51*b*, 51*c*, and 51*d* remove the residual toner on photosensitive drums 201*a* to 201*d* after the toner images have been transferred from photosensitive drums 201*a* to 201*d* to inter-stage transfer belt 121.

In this drawing, inter-stage transfer belt 121 is rotated in the direction of arrow "A" by driving rollers 105 and 111. In image-forming units 101*a* to 101*d*, a yellow image, a magenta image, a cyan image, and a black image are formed, respectively.

Next, single-color images of each color that have been formed on photosensitive drums 201*a* to 201*d* are transferred onto inter-stage transfer belt 121 sequentially one on another to form a full-color image.

Provided below inter-stage belt 121 is a paper feed cassette 161 for housing sheet material 11 such as printing paper. Sheet material 11 is fed from paper feed cassette 161 into paper-carrying passage by paper feed roller 181 sheet by sheet.

In the paper-carrying passage, sheet material transfer roller 191 is in contact with the outer peripheral surface of inter-stage transfer belt 121 so as to transfer the color image formed on this inter-stage transfer belt 121 onto the above-mentioned sheet material 11. Then, fixing unit 401 fixes onto sheet material 11 the toner image that has been transferred onto sheet material 11, using the pressure and heat produced by rotation of sheet material transfer roller 191.

Figure 2:
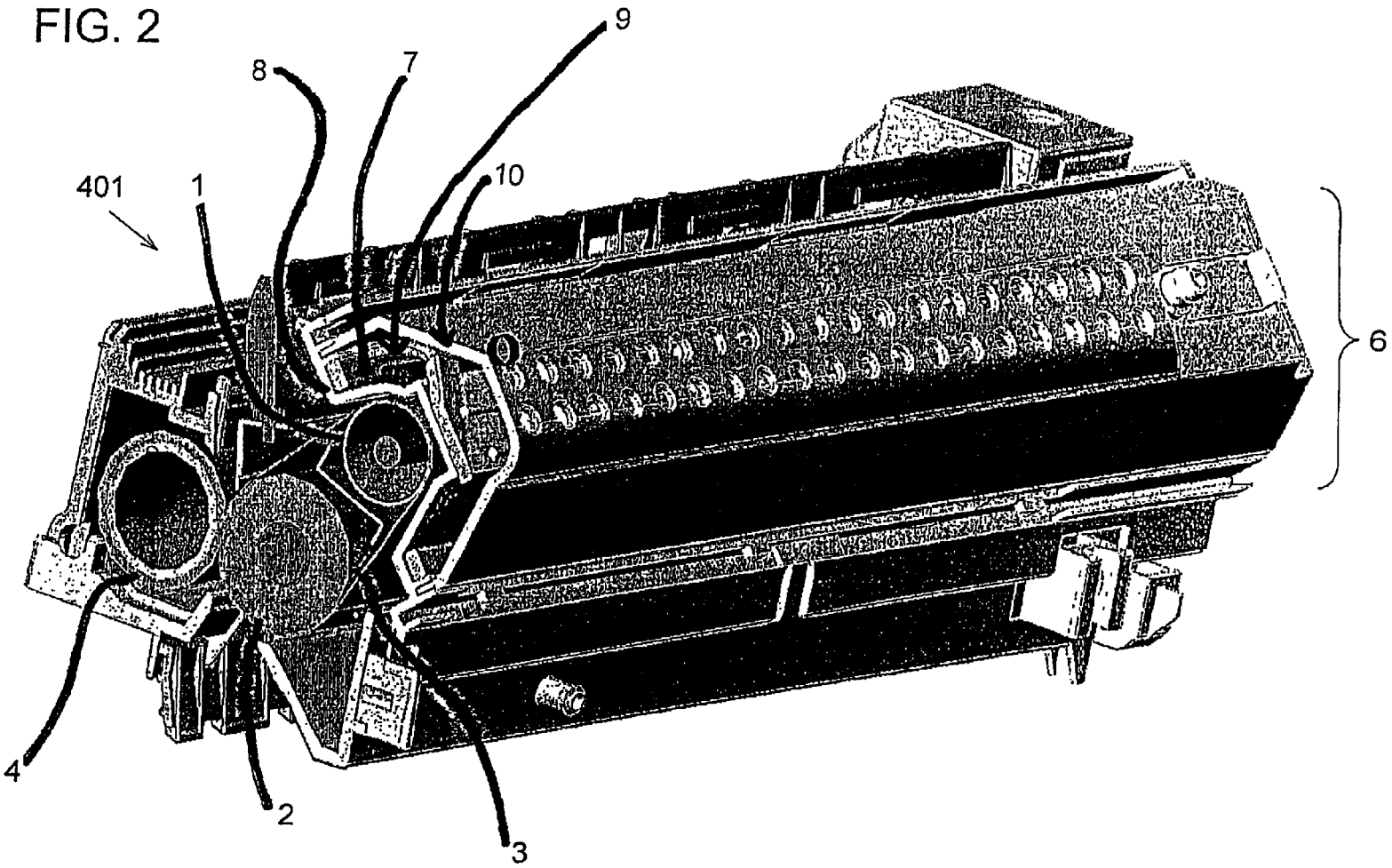
FIG. 2 is a general view of a fixing unit in accordance with first and second exemplary embodiments of the present invention.
Figure 3:
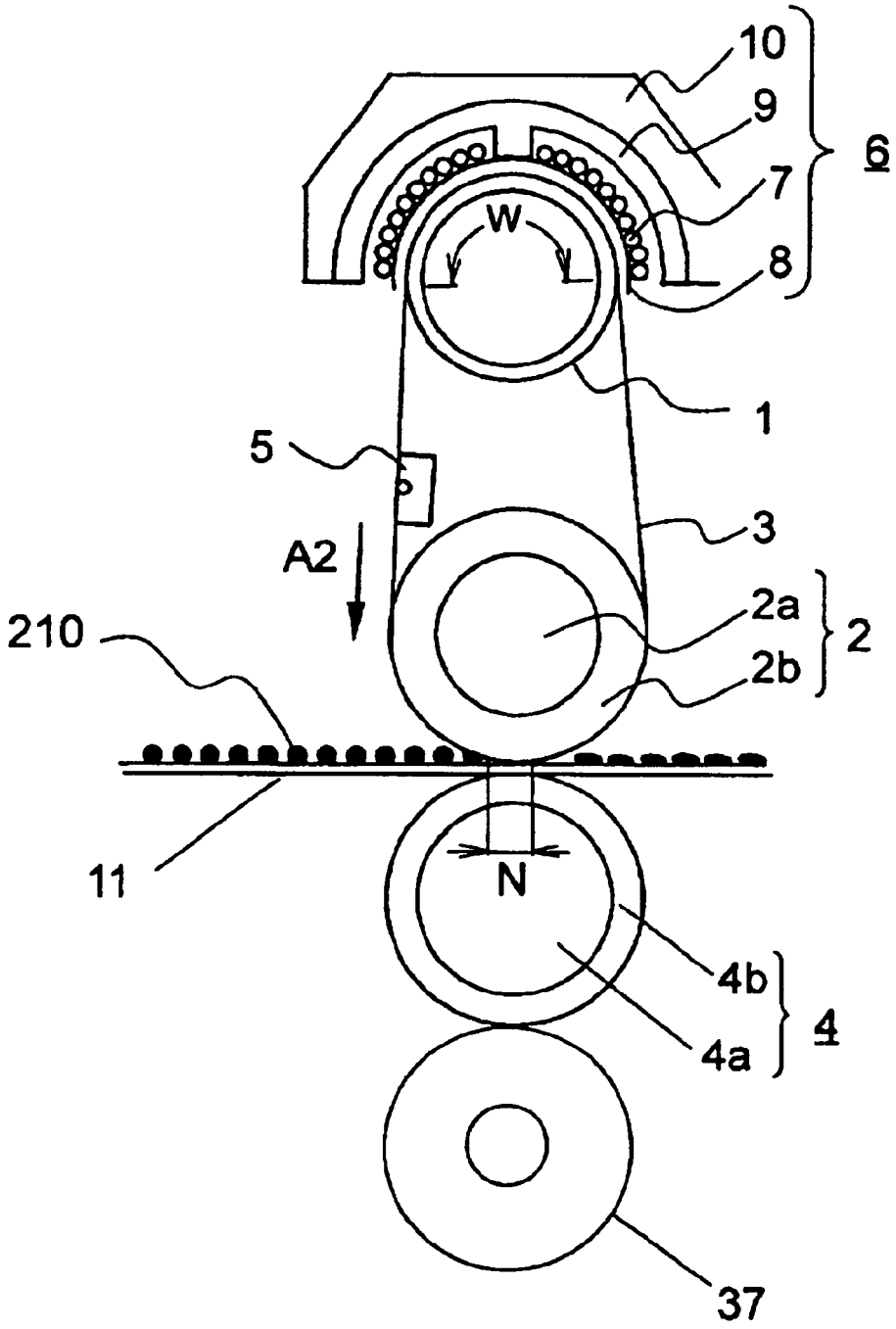
FIG. 3 is a cross-sectional view of the fixing unit in accordance with the first exemplary embodiment of the present invention.

Next, fixing unit 401 of the above-mentioned printer apparatus is detailed using FIGS. 2 and 3.

FIG. 2 is a general view showing fixing unit 401 in accordance with the first exemplary embodiment of the present invention.

FIG. 3 is a cross-sectional view showing a structure of fixing unit 401.

In the cross-sectional view of FIG. 3, heat-up roller 1, fixing roller 2, pressurizing roller 4 are shown as they are vertically aligned for convenience in explanation.

In FIG. 2 and FIG. 3, heat-up roller 1, fixing roller 2, endless band-like heat-resistant belt 3, pressurizing roller 4, heating section 6 are shown. Heating section 6 is an electromagnetic induction heating section and provided with exciting coil 7, coil guide 8, exciting coil core 9, and exciting coil core support 10.

In fixing unit 401 of FIG. 3, cylindrical heat-up roller 1 is heated along the outer circumferential surface thereof by the electromagnetic induction of heating section 6. Fixing roller 2 is disposed in parallel with heat-up roller 1. Endless band-like heat-resistant belt (belt section) 3 is held by heat-up roller 1 and fixing roller 2 under a tension, heated by heat-up roller 1, and rotated in the direction of arrow "A2" by the rotation of fixing roller 2. Pressurizing roller (pressurizing section) 4 is in contact with heat-resistant belt 3 to form a nip portion (shown by the portion "N" in the drawing). The pressurizing roller is also pressurized onto fixing roller 2 in contact therewith, and rotated in the direction identical with that of heat-resistant belt 3.

In FIG. 3, recording material 11, toner image 210, and temperature-detecting section 5 are also shown. Driving section 37 rotates pressurizing roller 4.

The material and other details of each component of fixing unit 401 are described below.

With reference to FIG. 3, heat-up roller 1 is made of a cylindrical hollow ferromagnetic metal, e.g. Fe, Ni, and stainless steel. For example, the outer diameter thereof is 20 mm and the thickness thereof is 0.3 mm. Therefore, heat-up roller 1 has low heat capacity and is heated up quickly.

Fixing roller 2 includes metallic core 2*a* made of such a metal as stainless steel, and elastic material portion 2*b* made of heat-resistant silicon rubber covering metallic core 2*a*. This silicon rubber is in the form of a solid or foam. Moreover, the pressurizing force of pressurizing roller 4 forms a predetermined width of contact portion between fixing roller 2 and this pressurizing roller 4. For this reason, the outer diameter of the fixing roller is approx. 30 mm, which is larger than that of heat-up roller 1. In fixing roller 2, elastic material portion 2*b* has a thickness of approx. 3 mm to 8 mm and a hardness of approx. 15° to 50 ° (Asker C).

With such a structure, because the heat capacity of heat-up roller 1 is smaller than that of fixing roller 2, heat-up roller is heated quickly and thus the warm-up time is reduced.

Heat-resistant belt 3 that is held between heat-up roller 1 and fixing roller 2 under a tension is heated in a portion "W" in which the belt is in contact with heat-up roller 1 heated by heating section 6 disposed along the outer circumferential surface of heat-up roller 1. Moreover, the inner surface of heat-resistant belt 3 is continuously heated by the rotation of heat-resistant belt 3 resulting from the rotation of fixing roller 2. As a result, belt 3 is heated entirely.

Heat-resistant belt 3 is a multilayer belt containing a base layer and a releasing layer (hereinafter referred to as a surface layer). The base layer is made of a heat-resistant material, e.g. fluorine plastic, polyimide resin, polyamide resin, polyamideimide resin, polyether ketone (PEEK) resin, polyether sulfone (PES) resin, and polyphenylene sulfide (PPS) resin. The surface layer is made of an elastic material, e.g. silicone rubber and fluoro rubber, covering the surface.

Such a structure allows heat-resistant belt 3 to conform to the curvature of heat-up roller 1 easily. In addition, because the base layer is made of a highly heat-resistant resin material, heat kept by heat-up roller 1 can be transferred to belt 3 efficiently.

In this case, the preferable thickness of the base layer is approx. 10 $\mu$m to 250 $\mu$m . Especially, approx. 75 $\mu$m is most preferable. On the other hand, the preferable thickness of the surface layer is approx. 30 $\mu$m to 400 $\mu$m . Especially, approx. 200 $\mu$m is most preferable. Such a structure allows toner image 210 formed on recording material 11 to be heated and melted uniformly.

As the base layer of heat-resistant belt 3, a ferromagnetic metallic material, e.g. Ni, Co, Cr and stainless steel, can also be used instead of a heat-resistant resin material, e.g. fluorine plastic, polyimide resin, polyamide resin, polyamide-imide resin, PEEK resin, PES resin, and PPS resin.

With the use of a metallic material, even when a gap is formed by entry of foreign matter between heat-resistant belt 3 and heat-up roller 1, the base layer of heat-resistant belt 3 containing the metallic material produces heat resulting from electromagnetic induction. This ensures heat-up of belt 3 without variation in temperatures.

The preferable thickness of the metallic material is approx. 10 $\mu$m to 60 $\mu$m. Especially, approx. 30 $\mu$m is most preferable.

Pressurizing roller 4 includes cylindrical metallic core 4*a* that is made of a metal having high thermal conductivity, such as stainless steel and Al, and elastic material 4*b* having high heat resistance and toner releasability that is provided over the surface of this metallic core 4*a*.

Such a pressurizing roller 4 pressurizes fixing roller 2 in contact with heat-resistant belt 3 to form the fixing nip portion "N".

In this embodiment, the outer diameter of pressurizing roller 4 is approx. 30 mm, which is similar to that of fixing roller 2, so that the toner releasing action at the exit of the fixing nip portion "N" is enhanced. On the other hand, the thickness of pressurizing roller 4 is approx. 2 mm to 5 mm, which is smaller than that of fixing roller 2. The hardness of the pressurizing roller is approx. 20° to 60° (Asker C), which is larger than that of fixing roller 2.

Figure 4A:
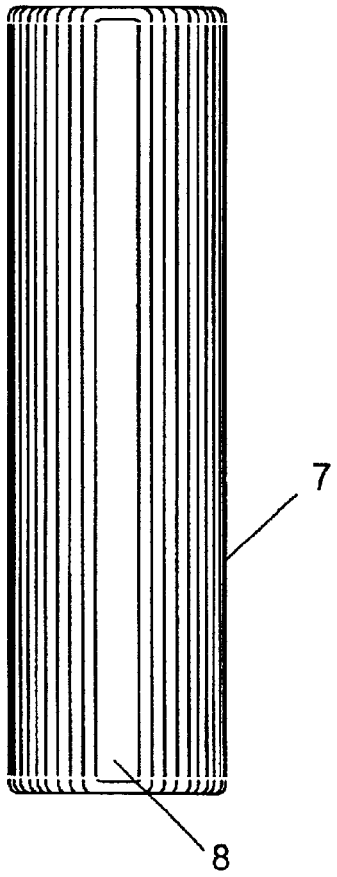
FIG. 4A is a plan view of an exciting coil of an electromagnetic induction heating section in accordance with the first exemplary embodiment of the present invention.
Figure 4B:
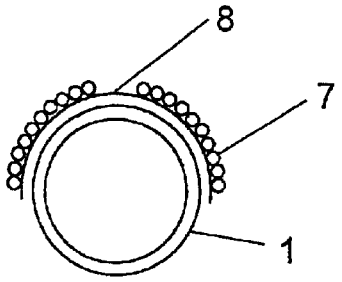
FIG. 4B is a cross-sectional view of the exciting coil of the electromagnetic induction heating section in accordance with the first exemplary embodiment of the present invention.

Heating section 6 for heating heat-up roller 1 using electromagnetic induction has exciting coil 7 for generating a magnetic field, and coil guide 8 having this exciting coil 7 wound thereon, as shown in FIGS. 4A and 4B.

Coil guide 8 is shaped like a semi-circular arc disposed adjacent to the outer circumferential surface of heat-up roller 1. Exciting coil 7 is made by a length of an exciting coil material wound along this coil guide 8 in a direction of the rotating shaft of heat-up roller 1. The area around which exciting coil 7 is wound is identical with the contact area between heat-resistant belt 3 and heat-up roller 1.

This structure maximizes the area of heat-up roller 1 to be heated by heating section 6. In addition, this structure maximizes the time when the heating surface of heat-up roller 1 is in contact with heat-resistant belt 3. Therefore, transfer efficiency of heat from heating section 6 to heat-resistant belt 3 is increased.

Figure 19:
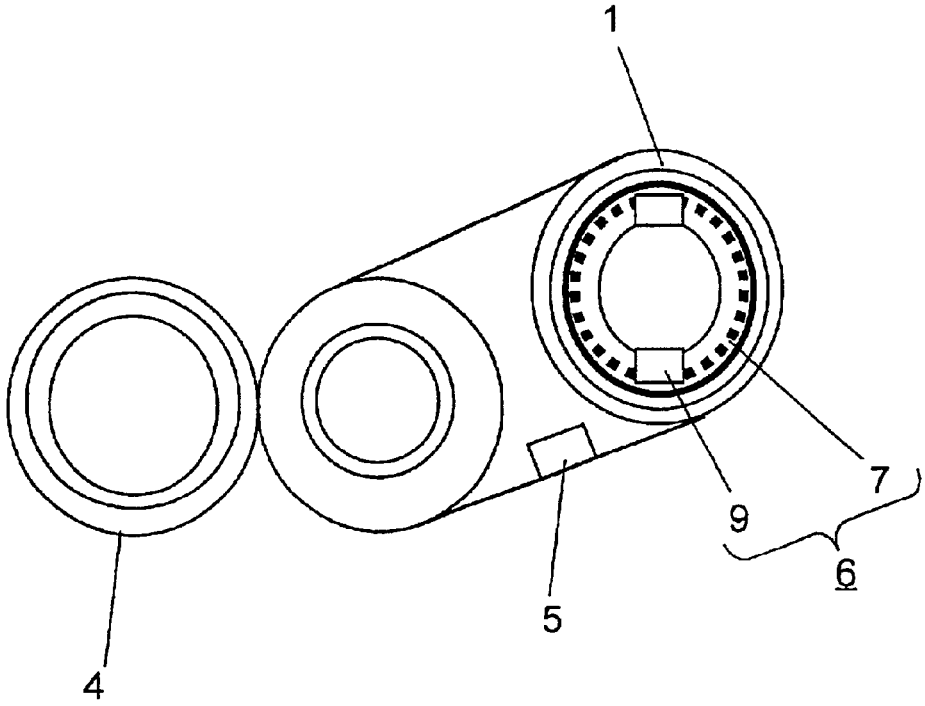
FIG. 19 illustrates another structure of the fixing unit in accordance with the first exemplary embodiment of the present invention.

As shown in FIG. 19, heating section 6 may also be disposed along the inner circumferential surface of heat-up roller 1.

Exciting coil 7 is connected to a driving power source (not shown) that has an oscillation circuit having variable frequencies.

Moreover, as shown in FIG. 3, exciting coil core 9 shaped like a semi-circular arc is disposed adjacent to exciting coil 7 outside thereof, and is secured to exciting coil core support 10. In this embodiment, used as exciting coil core 9 is a core integrally formed of the mixture of a ferromagnetic powder, e.g. iron, nickel, and ferromagnetic stainless steel, and a heat-resistant resin, e.g. PEEK resin, PES resin and PPS resin. Exciting coil core 9 can also be formed of such ferromagnetic materials as ferrite and permalloy.

Such a structure allows downsizing of exciting coil core 9 and reduction of material cost, and moreover, substantial reduction of the number of man-hours in assembling the core.

In addition, because exciting coil core 9 can be machined precisely to have a variety of shapes, heat-up roller 1 can be made to have uniform temperature distribution.

Figure 5A:
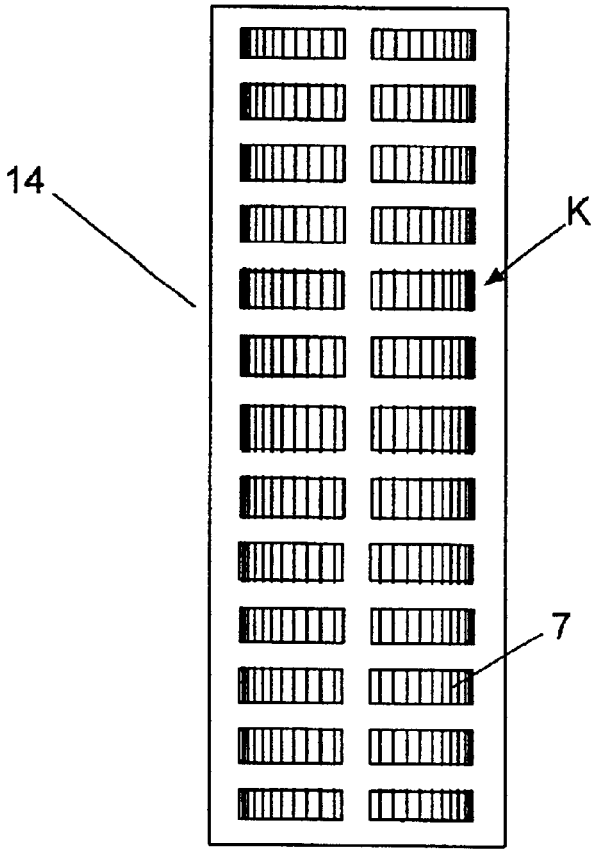
FIG. 5A is a plan view of an exciting coil core of the electromagnetic induction heating section in accordance with the first exemplary embodiment of the present invention.
Figure 5B:
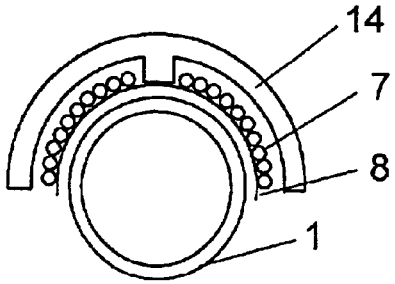
FIG. 5B is a cross-sectional view of the exciting coil core of the electromagnetic induction heating section in accordance with the first exemplary embodiment of the present invention.

Moreover, as shown in FIGS. 5A and 5B, a plurality of openings K can be provided on exciting coil core 14 to partially expose exciting coil 7. Such a structure allows heat produced by copper loss of exciting coil 7 and other causes to be released outside of heating section 6.

Exciting coil 7 receives high-frequency alternating current at frequencies of 10 kHz to 1 MHz, more preferably 20 kHz to 800 kHz, and generates an alternating magnetic field. This alternating magnetic field acts on heat-up roller 1 in the contact area "W" between heat-up roller 1 and heat-resistant belt 3 and a periphery thereof, as shown in FIG. 3. Inside of these areas, eddy current flows in the direction that hinders this change in magnetic field.

This eddy current produces Joule heat according to the resistance of heat-up roller 1. Heat-up roller 1 is heated mainly in the contact area between heat-up roller 1 and heat-resistant belt 3 and the periphery thereof, by the heat resulting from electromagnetic induction.

The temperature on the inner surface of heated heat-resistant belt 3 is detected by temperature-detecting section 5 that is made of a temperature-sensitive element having high thermal responsibility, such as a thermistor, on the entry side of the fixing nip portion "N".

As mentioned above, temperature-detecting section 5 is disposed on the back face of belt 3. Thus, temperature-detection section 5 does not damage the front face of belt 3. Therefore, fixing performance is continuously ensured and the temperature just before belt 3 enters the fixing nip portion "N" is detected.

Furthermore, the temperature of heat-resistant belt 3 can be maintained at 180° C., for example, in a stable manner, by the control of the power supply to heating section 6 based on the signals showing this temperature information.

In this embodiment, as shown in FIGS. 1 and 3, toner image 210 that has been formed on recording material 11 by image-forming units 101*a* to 101*d* is introduced into the fixing nip portion "N". At this time, recording material 11 is fed into the fixing nip portion "N" with little temperature difference between the front face and back face of heat-resistant belt 3 that has been heated by heating section 6. This can inhibit so-called overshoot, in which the temperature on the front face of the belt is excessively higher than a preset temperature, and thus stable temperature control can be performed.

Next, a heat controller of this embodiment is described.

Figure 6:
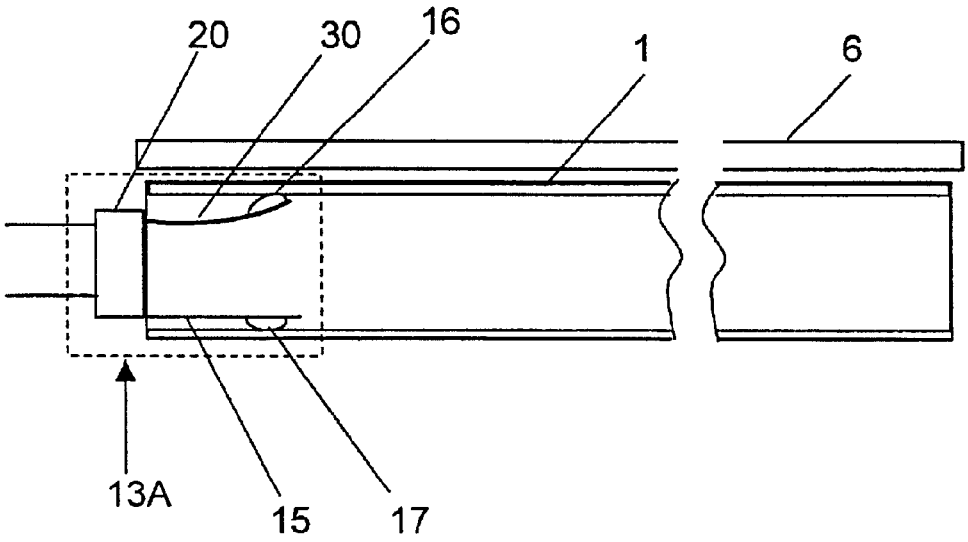
FIG. 6 is a longitudinal sectional view of a heat controller in accordance with the first exemplary embodiment of the present invention.

FIG. 6 is a longitudinal sectional view of heating section 6 and heat-up roller 1.

As shown in the drawing, heat controller 13A for overheat prevention is provided at an end of heat-up roller 1. As hereinafter detailed, this heat controller 13A may be provided on both ends of heat-up roller 1.

Now, a case where the heat controller is provided at an end of the heat-up roller is described.

Figure 17:
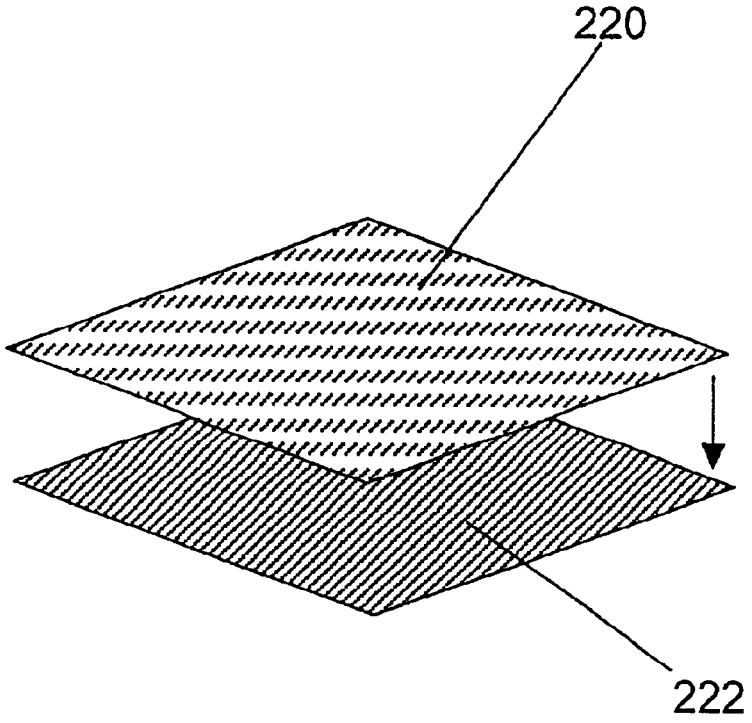
FIG. 17 illustrates a structure of the heat-sensitive operation section in accordance with the exemplary embodiments of the present invention.

Heat controller 13A has heat-sensitive operation section 30 shaped like a flat spring, and electrode 15. This heat-sensitive operation section 30 includes a bimetal that is thermally deformed in a direction farther from the inner circumferential surface of heat-up roller 1 when heated to temperatures above a predetermined value. This heat-sensitive operation section 30 is made of two different kinds of metals bonded together as shown in FIG. 17. In other words, a metal having high thermal expansion coefficient is used as metal 220 in contact with the inner surface of the heat-up roller. A metal having low thermal expansion coefficient is used as metal 222 that does not contact the inner surface of the heat-up roller. Therefore, with a temperature rise, the bimetal is deformed so that the length of the metal having higher thermal expansion coefficient increases.

Metals having high thermal expansion coefficients are made of such composite materials as Ni—Mo—Fe, Ni—Cr, and FeNi—Mn—Fe. Metals having low thermal expansion coefficients are made of such composite materials as Ni—Fe and Cr—Fe. Details on the combinations of materials are shown in Table 1.

TABLE 1

| Metal with high thermal expansion coefficient | Metal with low thermal expansion coefficient |
|---|---|
| Ni–Cr–Fe | Ni–Fe |
| Ni–Cr–Fe | Cr–Fe |
| Ni–Mn–Fe | Ni–Fe |

Figure 15A:
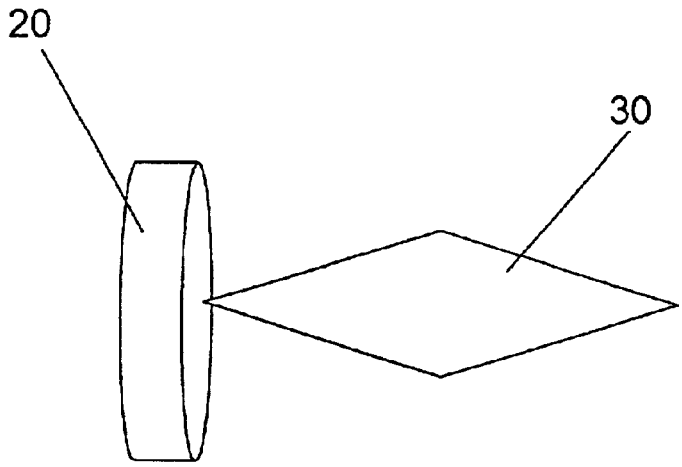
FIG. 15A is a perspective view of a heat-sensitive operation section in accordance with the first exemplary embodiment of the present invention.
Figure 15B:
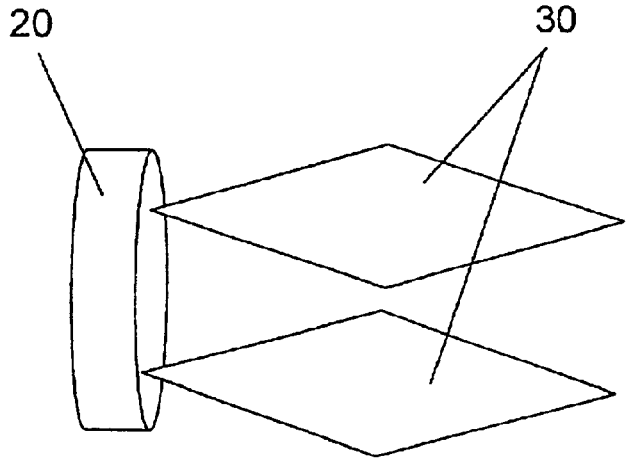
FIG. 15B is a perspective view of a heat-sensitive operation section in accordance with the first exemplary embodiment of the present invention.

FIGS. 15A and 15B show structures of heat-sensitive operation sections 30 disposed in heat-up roller 1.

FIG. 15A shows a case where a single heat-sensitive operation section 30 is disposed in heat-up roller 1. FIG. 15B shows an example of cases where a plurality of heat-sensitive operation sections 30 are disposed in heat-up roller 1. In these drawings, support member 20 is also shown.

As shown in the drawings, the heat-sensitive operation section 30 is shaped so that the dimension thereof along the longitudinal direction of heat-up roller 1 is larger than the dimension perpendicular to the longitudinal direction. Therefore, heat-sensitive operation section 30 has a shape that is deformed by heat without fail. However, when the heat-sensitive operation section 30 is shaped so that the dimension thereof along the longitudinal direction of heat-up roller 1 is shorter than the dimension perpendicular to the longitudinal direction, the operation section works.

In the case of the heat controller having a plurality of heat-sensitive operation sections, each heat-sensitive operation section may be structured to have different materials bonded together.

For example, when a plurality of bimetals are used as shown in FIG. 15B, one bimetal is made of a metal a having high thermal expansion coefficient and a metal having a low thermal expansion coefficient bonded together while the other bimetal is made of two metals bonded together that are different from the aforementioned metal materials.

In this case, a metal having a higher thermal expansion coefficient is used as a metal in contact with the inner surface of the heat-up roller.

In addition, with reference to FIG. 6, protrusions 16 and 17 are formed by press work and the like, on the tips of heat-sensitive operation section 30 and electrode 15, respectively. The tips of heat-sensitive operation section 30 and electrode 15 are brought into contact with the inner circumferential surface of heat-up roller 1 and pressurized thereto with a predetermined load via these protrusions 16 and 17.

This keeps electrical connection between the heat-up roller, i.e. a cylindrical rotating body, and heat-sensitive operation section 30, and thus heat controller 13A operates in a stable manner.

Figure 18A:
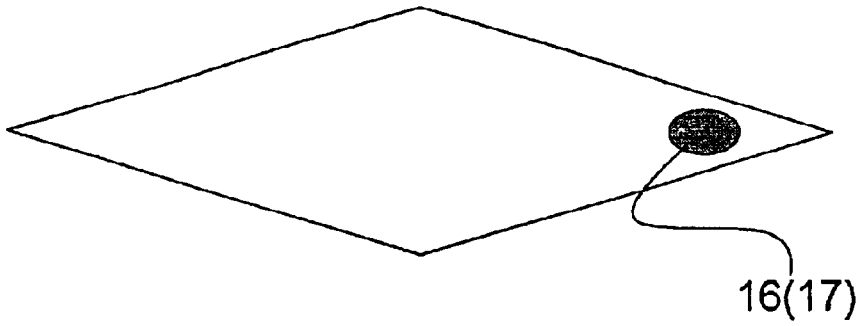
FIG. 18A is a top view of a protrusion in the heat-sensitive operation section in accordance with the exemplary embodiments of the present invention.
Figure 18B:
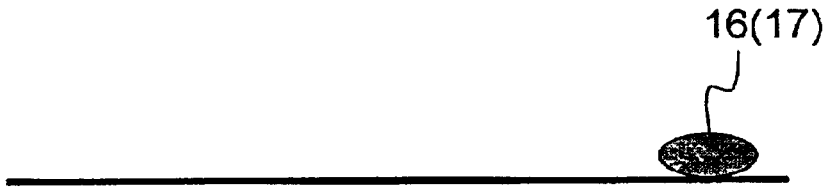
FIG. 18B is a side view of the protrusion in the heat-sensitive operation section in accordance with the exemplary embodiments of the present invention.

Now, protrusions 16 and 17 are detailed using FIGS. 18A and 18B. Forming protrusions 16 and 17 in contact with the inner circumferential surface of heat-up roller 1 as a semi-spherical shape ensures intimate contact of protrusions 16 and 17 with the inner circumferential surface of the heat-up roller.

Over protrusions 16 and 17 formed on the tips of heat-sensitive operation section 30 and electrode 15, a metal having high thermal conductivity and low electrical resistance, e.g. Cu, Ag, and Pt, is crimped. This can reduce electrical resistance in the contact portions between protrusions 16 and 17 and the inner circumferential surface of heat-up roller 1. Thus heat production of heat-sensitive operation section 30 is reduced. In this manner, the temperature detection accuracy of heat-sensitive operation section 30 can be improved. The crimped portions are crushed and thus the protrusions are secured to the bimetals by crimping.

Next, the operation of the heat controller of this embodiment is described below.

With reference to FIG. 6, heat-sensitive operation section 30 and electrode 15 are secured to the body of fixing unit 401 via support 20 and structured to slide on the inner surface of heat-up roller 1.

As mentioned above, heat-sensitive operation section 30 as a heat controller is normally in contact with heat-up roller 1, in a position opposite to electromagnetic induction heating section 6 as a heating section, sandwiching heat-up roller 1. Therefore, the heat controller performs excellent temperature control against rapid and local heating of heat-up roller 1.

Figure 7:
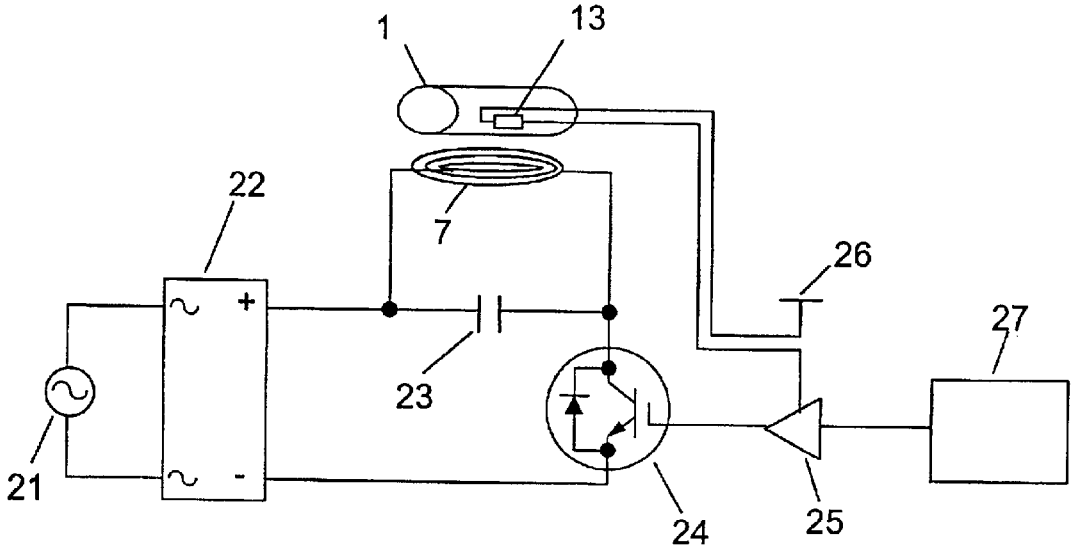
FIG. 7 is a block diagram showing circuitry for causing the electromagnetic induction heating section in accordance with the first and second exemplary embodiments of the present invention to generate a magnetic field.

Next, peripheral devices of the fixing unit using the electromagnetic induction heating method structured as above and a control method thereof are described using the circuit diagram of FIG. 7.

The circuit diagram of FIG. 7 shows heat-up roller 1, exciting coil 7, heat controller 13, commercial power source 21, rectifier element 22, resonant capacitor 23, switching element 24, switching element driver 25, DC power source 26, and controller 27.

Rectifier element 22 performs full-wave rectification of commercial power source 21. Resonant capacitor 23 is connected in parallel to exciting coil 7. Connected in series with rectifier element 22 in order to pass high-frequency current through capacitor 23 and exciting coil 7 in parallel is switching element 24 for insulated gate bipolar transistor (IGBT) driving. In the IGBT driving, the switching element is driven. Switching element driver 25 contains such an IC for the IGBT. Driver 25 drives the gate of switching element 24. Connected to driver 25 via heat controller 13 is 20-V DC power source 26, for example. Controller 27 feeds on/off signals to switching element driver 25. Thus, high-frequency current flows through exciting coil 7.

Now, DC power source 26 and switching element driver 25 are connected in series with heat controller 13 via heat-up roller 1. Because the operating current thereof is approx. 20 mA, as heat-sensitive operation section 30, a small one having excellent heat response and low heat capacity is used.

As mentioned above, normally, electrical conduction of both ends of heat-sensitive operation section 30 is continued. However, when the operation section exceeds a predetermined temperature while the current is carried, electrical conduction of both ends of heat-sensitive operation section 30 is discontinued. In this embodiment, used is heat-sensitive operation section 30 that leaves the inner surface of heat-up roller 1 at a temperature of 200° C.

In such a circuit, under normal conditions, heat-up roller 1 is controlled to keep temperatures of approx. 180° C. Heat-sensitive operation section 30 is in contact with the inner surface of heat-up roller 1.

When some causes disable temperature control and bring heat-up roller 1 into a thermal runaway state during the rotation of the heat-up roller, the temperature thereof rapidly increases and then the temperature of heat-sensitive operation section 30 also increases following the temperature of heat-up roller 1.

Figure 8:
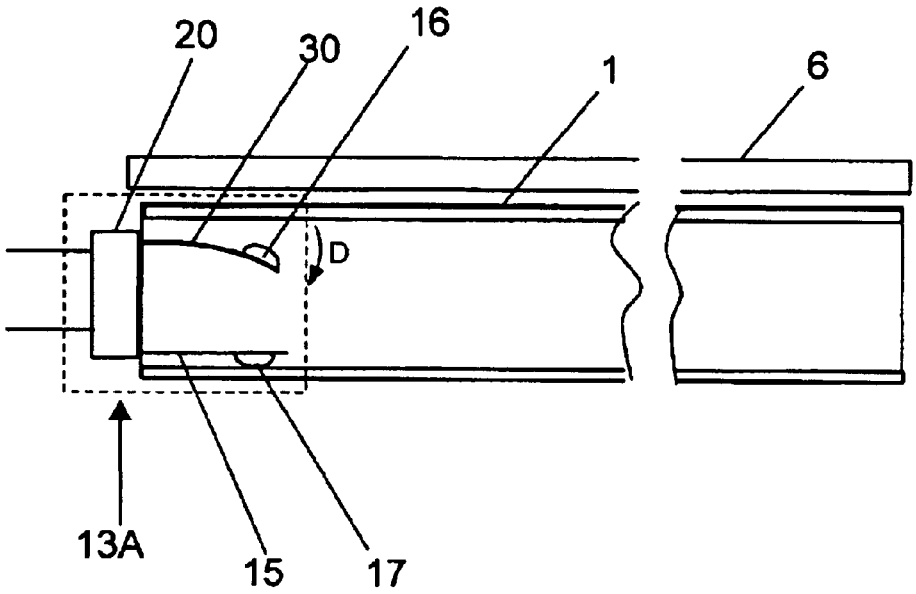
FIG. 8 illustrates how the heat controller in accordance with the first exemplary embodiment of the present invention performs an interruption operation.

Furthermore, when the temperature rise continues and the temperature of heat-sensitive operation section 30 exceeds 200° C., heat-sensitive operation section 30 is thermally deformed in the direction of arrow "D" as shown in FIG. 8 and leaves the inner circumferential surface of heat-up roller 1. As a result, electrical connection between heat-sensitive operation section 30 and heat-up roller 1 is discontinued, and thus no current flows. Therefore, no power is supplied from DC power source 26 to switching element driver 25. At this time, the output of switching element driver 25 is reduced, and thus the gate of switching element 24 is turned off. As a result, no current flows through exciting coil 7 and heating section 6 stops operation.

As mentioned above, because heat-sensitive operation section 30 is disposed in the power line of switching element driver 25 having low current and voltage values in this embodiment, heat-sensitive operation section 30 is small and the heat capacity thereof can be made small. Therefore, temperature control against rapid temperature rise in heat-up roller 1 can be ensured. This allows prevention of rapid temperature rise in heat-resistant belt 3 heated by electromagnetic induction of heating section 6 and thus thermal deformation of the fixing unit.

However, when some causes hinder heat controller 13 having heat-sensitive operation section 30 from operating normally at a predetermined temperature, heat-up roller 1 may be heated rapidly. For this reason, it is desirable to provide a plurality of heat controllers 13 in fixing unit 401 using heating section 6.

Figure 9:
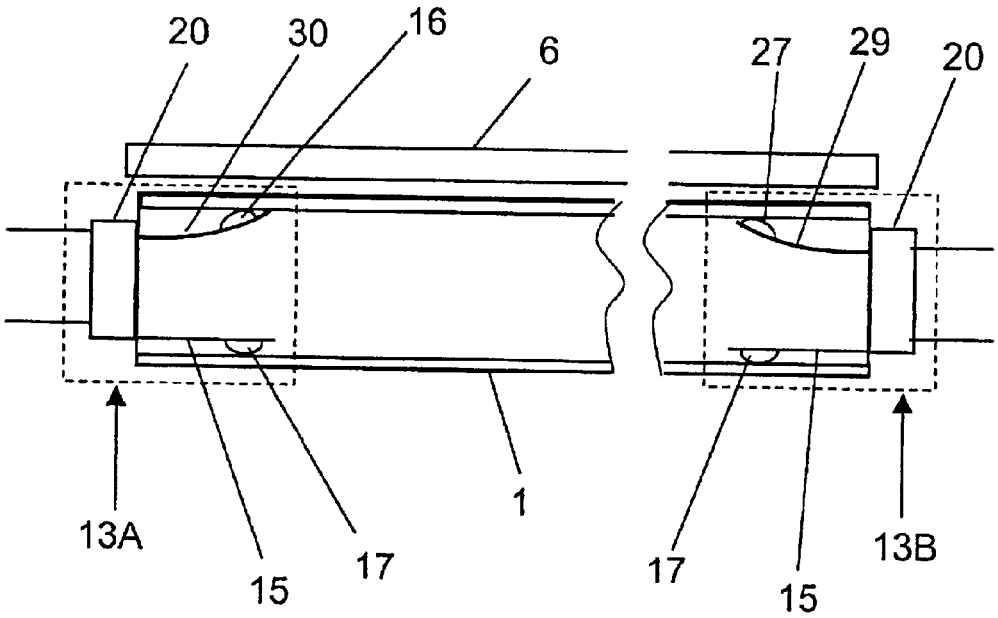
FIG. 9 illustrates a heat controller in accordance with the first exemplary embodiment of the present invention.

Therefore, in this embodiment, another heat controller 13B including heat-sensitive operation section 29 and electrode 15 is provided at the other end of heat-up roller 1, as shown in FIG. 9. Heat controllers 13A and 13B are connected in series.

In addition, a metal having high thermal conductivity and low electrical resistance may be crimped over protrusions 27 and 17 formed on the tips of this heat-sensitive operation section 29 and electrode 15, respectively.

As a result, even when heat-sensitive operation section 30 provided at one end of heat-up roller 1 does not operate normally at a predetermined temperature, heat-sensitive operation section 29 provided on the other end performs an interrupting operation. Therefore, overheating of heat-up roller 1 can be prevented and safe operation of fixing unit 401 can be further ensured.

Figure 10:
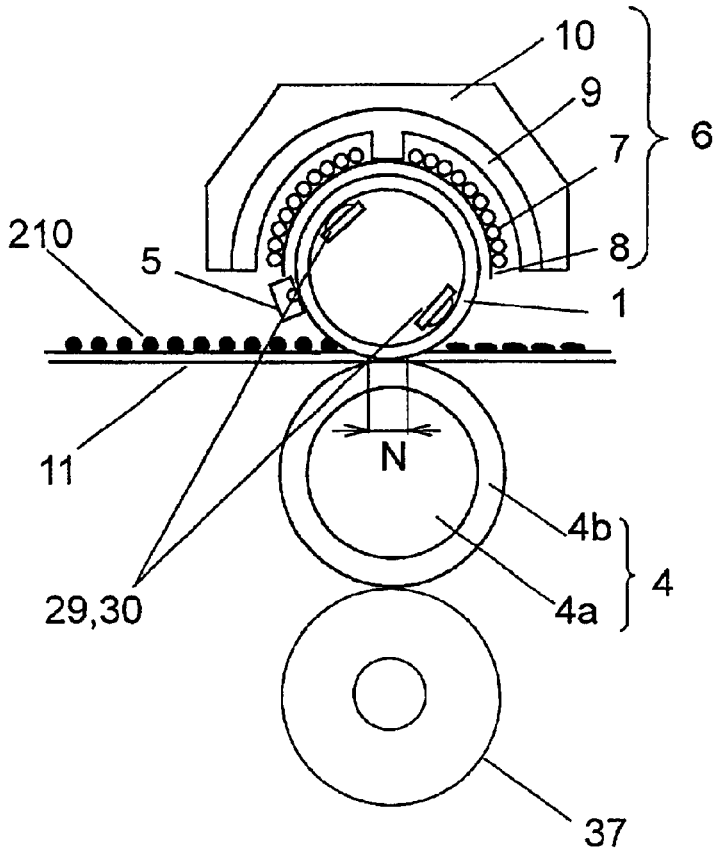
FIG. 10 is a cross-sectional view of a fixing unit in accordance with the first exemplary embodiment of the present invention.

The advantage of the above-mentioned structure of the heat controller can be obtained as well when fixing unit 401 is structured as shown in FIG. 10.

In this structure, fixing unit 401 includes heat-up roller 1 heated by electromagnetic induction of heating section 6 along the outer circumferential surface of the heat-up roller, and pressurizing roller 4. Pressurizing roller 4 is in contact with heat-up roller 1 to form a nip portion "N" and rotated in the direction identical with that of heat-up roller 1.

(Second Embodiment)

Next, a second exemplary embodiment of the present invention is described below.

Figure 11:
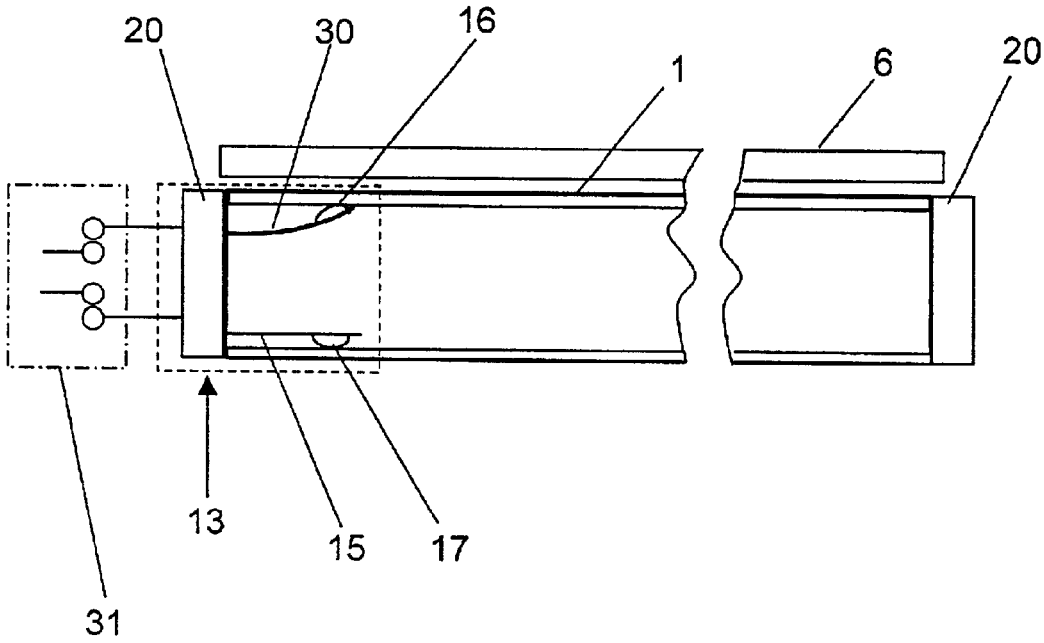
FIG. 11 is a longitudinal sectional view showing a structure of a heat controller in accordance with the second exemplary embodiment of the present invention.

FIG. 11 is a longitudinal sectional view of a heat-up roller in accordance with the second exemplary embodiment of the present invention.

What differs from the first embodiment is only the structure of the end of the heat-up roller, and only this part is described with reference to FIG. 11.

Heat-up roller 1 shown in FIG. 11 is secured to the body of the fixing unit via flange 20, which is an end of heat-up roller 1, and heat-sensitive operation section 30 is rotated together with heat-up roller 1.

With this structure, when heat-up roller 1 is rotated, heat-sensitive operation section 30 can be brought into intimate contact with heat-up roller 1, without sliding. Therefore, the portion in which heat-sensitive operation section 30 is in contact with heat-up roller 1 will not be worn and thus an excellent contact condition is always maintained. This further ensures temperature adjustment against rapid temperature rise in heat-up roller 1.

However, in the fixing unit of the second embodiment, when some causes hinder normal operation of temperature controller 13 having heat-sensitive operation section 30 shown in FIG. 11, like the first embodiment, heat-up roller 1 may be heated rapidly and damaged. For this reason, it is desirable to take countermeasures for the fixing unit using heating section 6, assuming such accidents.

Figure 12:
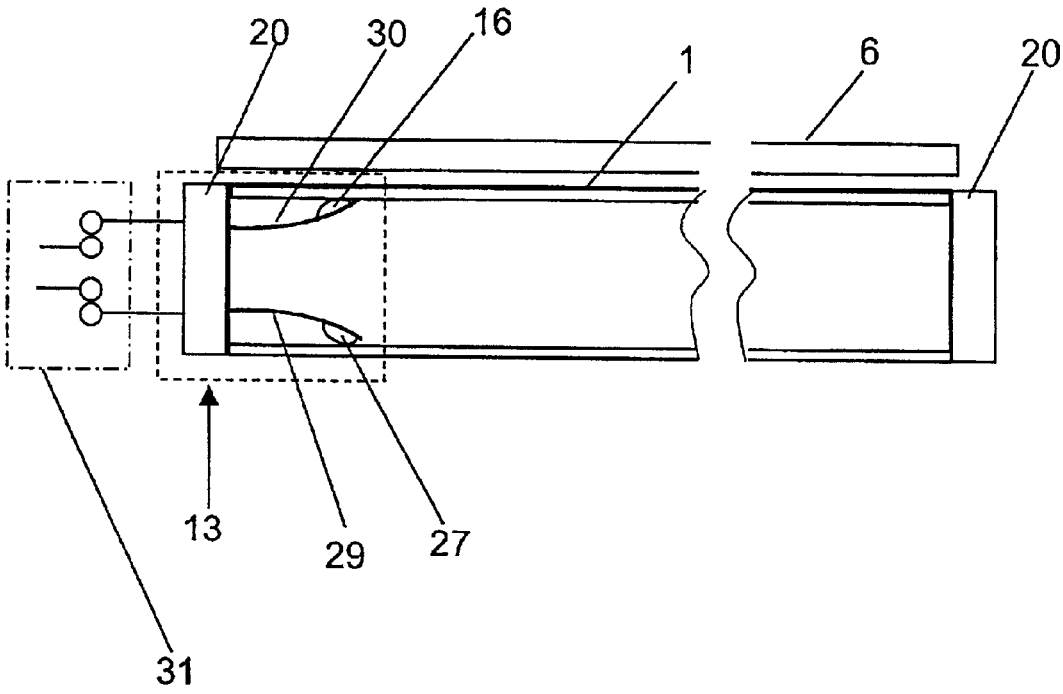
FIG. 12 is a longitudinal sectional view of a heat controller in accordance with the second exemplary embodiment of the present invention.

Then, in a fixing unit in accordance with the second embodiment, temperature controller 13 that has heat-sensitive operation section 29 as shown in FIG. 12 instead of electrode 15 is disposed. Heat-sensitive operation sections 29 and 30 are electrically connected in series with each other. Thus, even when heat-sensitive operation section 29 does not normally work at a predetermined temperature because of failure, the other heat-sensitive operation section 30 performs an interrupting operation. Therefore, overheating of heat-up roller 1 can be prevented and safe operation of fixing unit 401 can be further ensured.

A metallic material having high thermal conductivity and low electrical resistance can also be crimped over protrusion 27 formed on the tip of this heat-sensitive operation section 29.

Figure 13A:
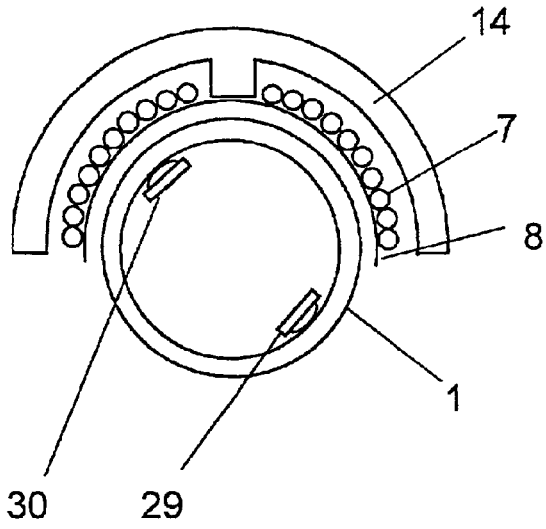
FIG. 13A illustrates a position of the heat controller in the fixing unit shown in FIG. 12 when rotation is stopped.
Figure 13B:
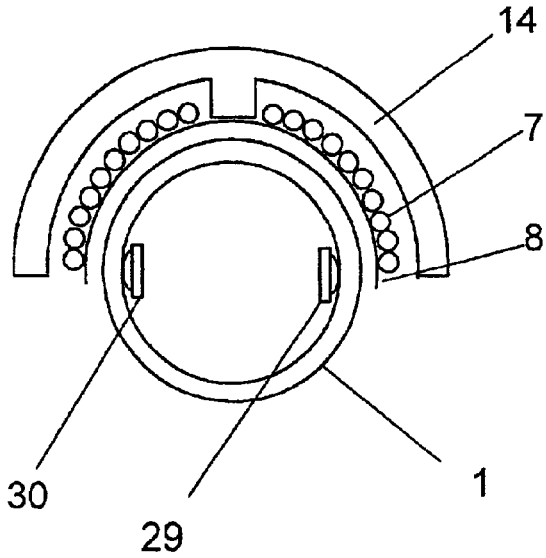
FIG. 13B illustrates a position of the heat controller in the fixing unit shown in FIG. 12 when rotation is stopped.

Furthermore, also in this second embodiment, two heat-sensitive operation sections 29 and 30 including bimetals are provided in opposite positions along the circumferential direction of heat-up roller 1, as shown in the cross-sectional views of the electromagnetic induction heating section of FIGS. 13A and 13B.

This configuration allows either one of heat-sensitive operation sections 29 and 30 to be always disposed in a position opposite to heating section 6 via heat-up roller 1. It is assumed that some causes may stop the rotation of heat-up roller 1. At that time, heating section 6 will heat half of a circumferential area of heat-up roller 1 locally. In such a case, heat-sensitive operation sections 29 and 30 can immediately respond to the rapid and local temperature rise in heat-up roller 1.

Now, how the periphery of rotating shaft 230 is when the heat controller of this embodiment is rotated together with heat-up roller 1 is detailed with reference to FIGS. 16A and B.

Figure 16A:
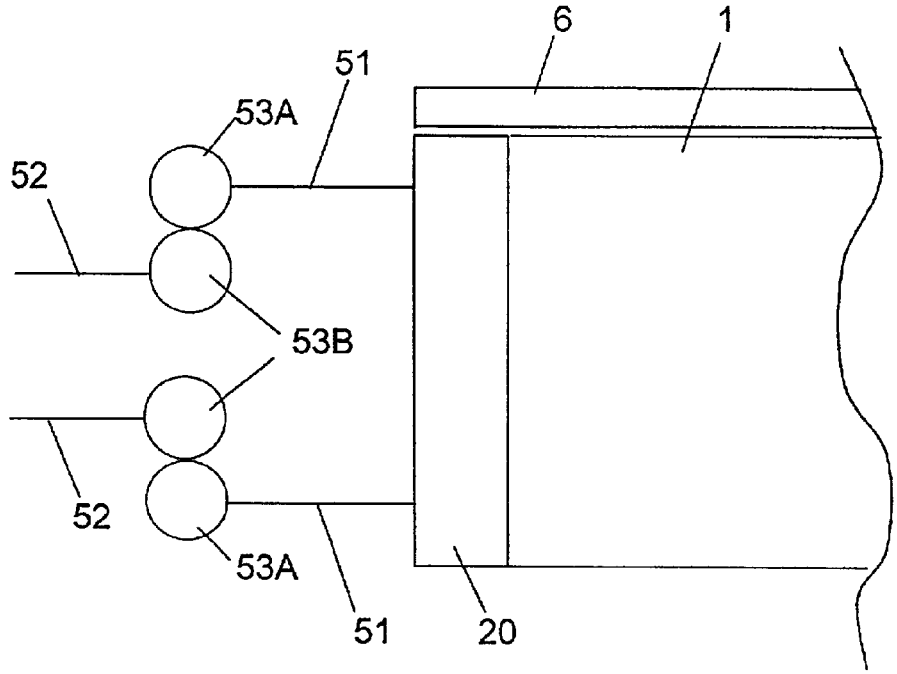
FIG. 16A is a longitudinal sectional view of a periphery of a rotating shaft connected to a heat-up roller in accordance with the second exemplary embodiment of the present invention.

FIG. 16A is a longitudinal sectional view of a periphery of rotating shaft 230 along rotating shaft 230.

Figure 16B:
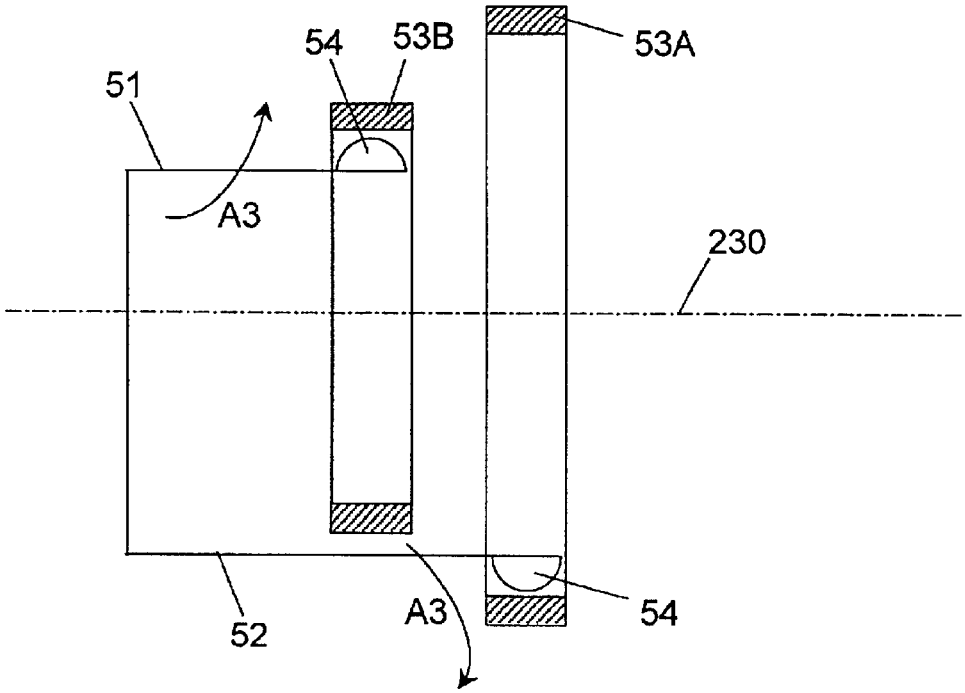
FIG. 16B is a top view of the periphery of the rotating shaft connected to the heat-up roller in accordance with the second exemplary embodiment of the present invention.

FIG. 16B is a top view of the periphery of rotating shaft 230.

Inside electrode 53B coupled to electrodes 52 is fixed. On the other hand, electrode 53A coupled to electrodes 51 rotates with respect to fixed electrode 53B. In other words, while electrodes 51 coupled to heat-up roller 1 and ring-like electrode 53A rotate, ring-like electrode 53B is fixed.

In addition, protrusions 54 are provided on the ends of electrodes 51 and 52. Protrusions 54 are in contact with the inner surfaces of ring-like electrodes 53, utilizing resilient force in the direction of arrow "A3" of the flat springs of electrodes 51 and 52. Current flows through these electrodes 51 and 52 and the current is carried to heat-up roller 1.

Figure 14:
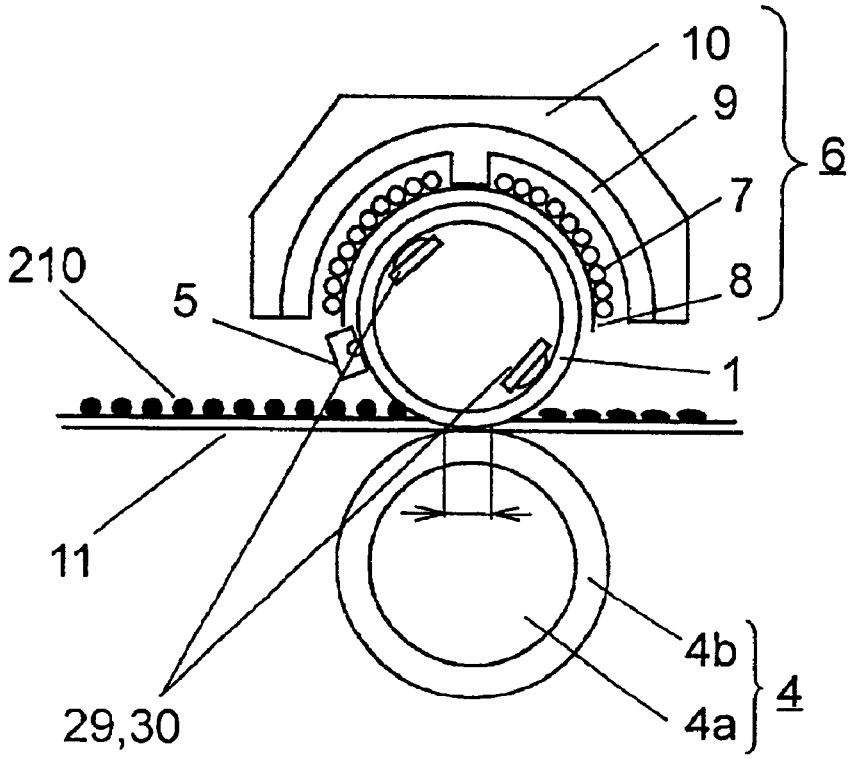
FIG. 14 is a cross-sectional view of a fixing unit in accordance with the second exemplary embodiment of the present invention.

The advantage of the above-mentioned structure of the heat controller can be obtained as well when fixing unit 401 is structured as shown in FIG. 14. The structure of this fixing unit has been described at the end of the explanation of the first embodiment.

(Third Embodiment)

Next, a third exemplary embodiment of the present invention is described.

Figure 20:
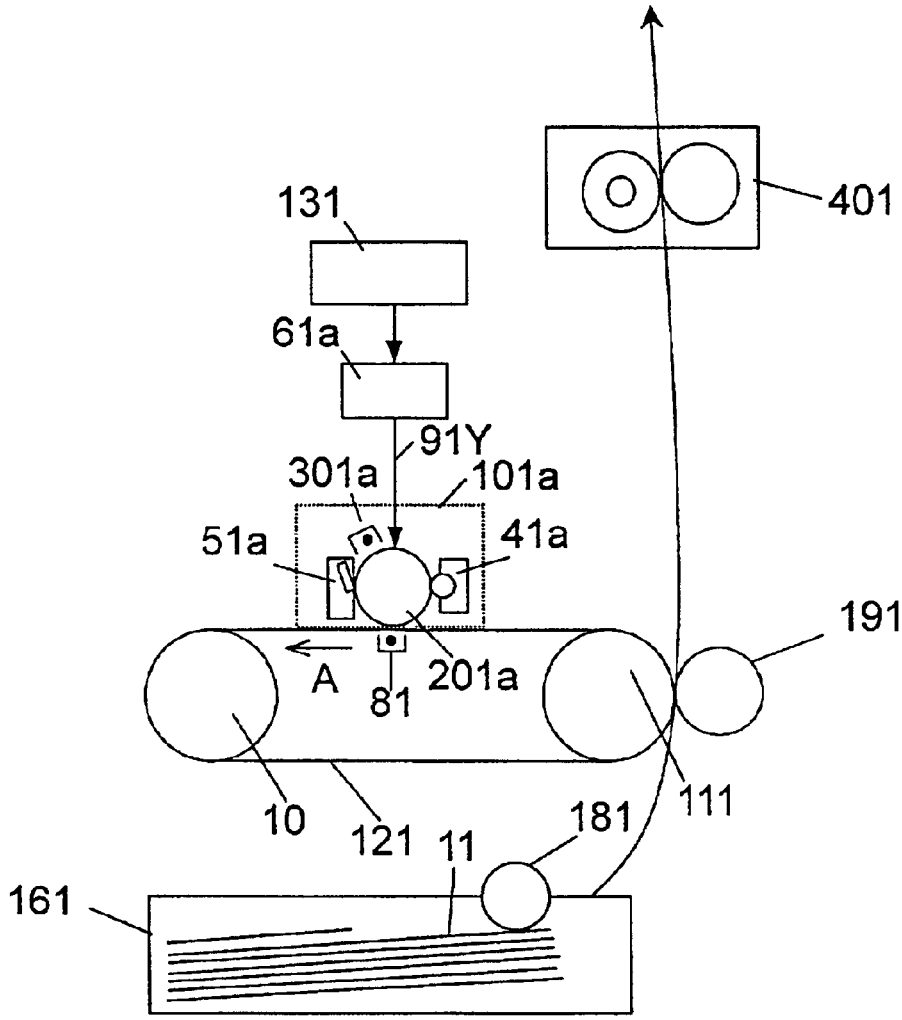
FIG. 20 illustrates a printer apparatus in accordance with a third exemplary embodiment of the present invention.

FIG. 20 shows a structure of an example of a printer apparatus having a fixing unit in accordance with the first and second embodiments of the present invention.

Figure 21:
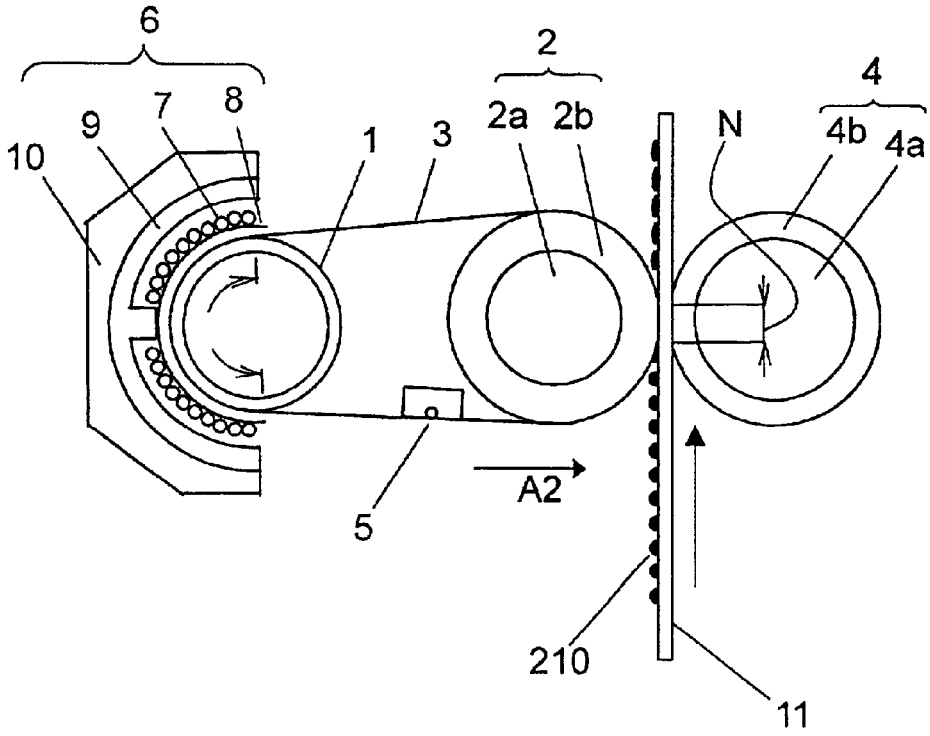
FIG. 21 is a detailed drawing of a fixing unit for use in the printer apparatus in accordance with the third exemplary embodiment of the present invention.
Figure 22:
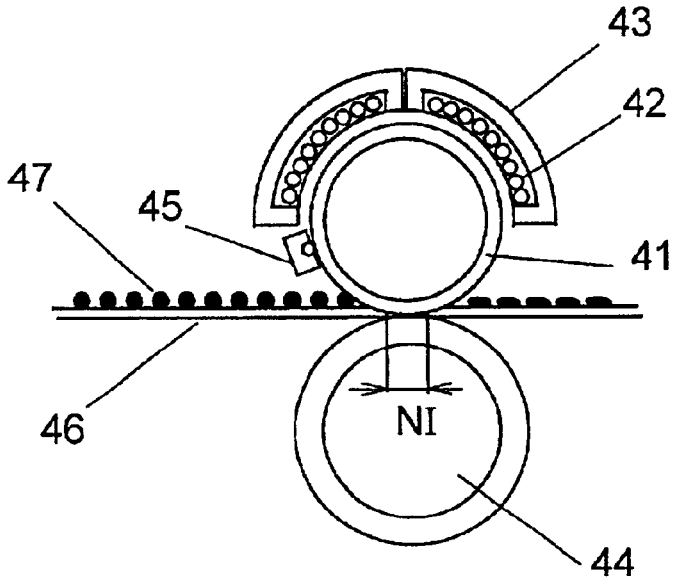
FIG. 22 PRIOR ART
FIG. 22 illustrates a structure of a fixing unit in accordance with a conventional technique.

FIG. 21 is a detailed drawing of fixing unit 401 shown in FIG. 20.

The printer apparatus shown in FIG. 20 has only one image-forming unit 101*a* for convenience in explanation. A plurality of image-forming units 101*a* can be disposed.

The name and function of each component is omitted because they have already been described in the first embodiment.

A printer apparatus having a fixing unit in accordance with the third embodiment of the present invention is described below.

As shown in the drawing, electric charger 301*a* disposed in the periphery of photosensitive drum 201*a* electrically charges the surface of photosensitive drum 201*a*. Next, exposure unit 61*a* irradiates the surface of the above-mentioned charged photosensitive drum 201*a* with laser light 91Y corresponding to image data to form a latent image. As a result, development section 41*a* visualizes the latent image formed on photosensitive drum 201*a* as a toner image. Then, transfer section 81*a* transfers the visualized toner image onto inter-stage transfer belt 121.

Next, sheet material transfer roller 191 transfers onto recording material 11 the toner image 210 that has been transferred onto inter-stage transfer belt 121. Thereafter, as shown in FIG. 21, fixing unit 401 fixes onto recording material 11 the toner image that has been transferred onto recording material 11.

At this time, in the same manner as in the first and second embodiments, the heat of fixing roller 2 that is produced by heat-up roller 1 heated by heating section 6 and the pressurizing force of pressurizing roller 4 fix the toner image onto recording material 11.

As mentioned above, in accordance with the first and second embodiments of the present invention, heating section 6 ensures the heating of heat-up roller 1 and temperature control. Therefore, fixing unit 401 fixes toner image onto recording material 11 in an excellent manner. In addition, when the heat-sensitive operation section leaves heat-up roller 1, power supply to the heating section is interrupted. Therefore, the temperature of heat-up roller 1 can be detected immediately and excessive temperature rise in heat-up roller 1 can be prevented.

Moreover, by the use of the heat-sensitive operation section, the power supply interruption section as a heat controller is downsized and thus the component cost is reduced.

Shown in the above-mentioned first to third embodiments are cases where an electromagnetic induction heating method is used in heating section 6 for heating heat-up roller 1. However, heating methods are not limited to this method, and the advantages of this invention can also be obtained with a lamp heating method using a halogen lamp.

What is claimed is:

1. A printer apparatus comprising:

(a) an image-forming unit for forming an image to be transferred onto a recording material; and (b) a fixing unit for fixing said image onto said recording material, said fixing unit including:

i) a heat-up roller;

ii) a heating section for heating said heat-up roller;

iii) a power supply section for supplying power to said heating section; and iv) a heat controller for controlling said power supply section;

wherein said heat controller is in contact with an inner circumferential surface of said heat-up roller, and is thermally deformed at temperatures above a predetermined value and leaves said inner circumferential surface to interrupt power supply of said power supply section to said heating section.

2. The printer apparatus as set forth in claim 1, wherein said fixing unit further includes a pressurizing roller.

3. The printer apparatus as set forth in claim 2, wherein said fixing unit further comprises:

a fixing roller; and a belt for engaging said fixing roller and said heat-up roller.

4. The printer apparatus as set forth in claim 1, wherein said heat controller and said inner circumferential surface of said heat-up roller is a part of a power line to said power supply section.

5. The printer apparatus as set forth in claim 1, wherein said heating section comprises:

an exciting coil; and a metal provided on said heat-up roller and producing heat resulting from an electrical field of said exciting coil.

6. The printer apparatus as set forth in claim 5, wherein said heating section further includes an exciting coil core having a plurality of openings.

7. The printer apparatus as set forth in claim 1, wherein said heat controller is disposed at a first longitudinal end of said heat-up roller, and an additional heat controller is disposed at a second longitudinal end of said heat-up roller.

8. The printer apparatus as set forth in claim 1, wherein said heat controller includes a bimetal.

9. The printer apparatus as set forth in claim 8, wherein said heat controller includes another bimetal formed of a different bimetal material.

10. The printer apparatus as set forth in claim 1, wherein a dimension of said heat controller in a longitudinal direction of said heat-up roller is longer than a dimension perpendicular to the longitudinal direction.

11. The printer apparatus as set forth in claim 1, wherein said heat controller includes a protrusion formed on a tip thereof that is in contact with the inner circumferential surface of said heat-up roller.

12. The printer apparatus as set forth in claim 11, wherein said protrusion is rounded.

13. The printer apparatus as set forth in claim 11, wherein one of silver and platinum is crimped over said protrusion.

14. printer apparatus as set forth in claim 1, wherein said heat controller constitutes one of a pair of heat controllers provided opposite to one another.

15. The printer apparatus as set forth in claim 1, wherein said heat controller slides in said heat-up roller.

16. The printer apparatus as set forth in claim 3, wherein said fixing unit further includes a temperature-detecting section in proximity to a fixing nip portion.

17. The printer apparatus as set forth in claim 16, wherein said temperature-detecting section is disposed on a back face of said belt of said printer apparatus.

18. The printer apparatus as set forth in claim 3, wherein said belt includes:

a heat-resistant base layer; and a surface layer made of an elastic material that covers a surface of said base layer.

19. The printer apparatus as set forth in claim 18, wherein a thickness of said base layer is 10 $\mu$m to 250 $\mu$m.

20. The printer apparatus as set forth in claim 18, wherein a thickness of said surface layer is 30 $\mu$m to 400 $\mu$m.

21. The printer apparatus as set forth in claim 18, wherein said base layer is a ferromagnetic metal.

22. The printer apparatus as set forth in claim 21, wherein a thickness of said metal is 10 $\mu$m to 60 $\mu$m.

23. The printer apparatus as set forth in claim 3, wherein said fixing roller includes:

a metallic core; and an elastic portion for covering said metallic core with silicon rubber.

24. The printer apparatus as set forth in claim 23, wherein a thickness of said elastic portion is 3 mm to 8 mm.

25. The printer apparatus as set forth in claim 3, wherein an outer diameter of said fixing roller is larger than an outer diameter of said heat-up roller.

26. The printer apparatus as set forth in claim 3, wherein a hardness of a surface layer of said fixing roller is 15° to 50° in Asker C hardness.

27. The printer apparatus as set forth in claim 2, wherein said pressurizing roller includes:

a metallic core; and a surface layer that is an elastic portion provided on a surface of said metallic core.

28. The printer apparatus as set forth in claim 3, wherein said pressurizing roller includes:

a metallic core; and a surface layer that is an elastic portion provided on a surface of said metallic core;

wherein a thickness of said elastic portion is smaller than a thickness of an elastic portion of said fixing roller.

29. The printer apparatus as set forth in claim 28, wherein a thickness of said elastic portion provided on the surface of said metallic core is 2 mm to 5 mm.

30. The printer apparatus as set forth in claim 3, wherein an outer diameter of said pressurizing roller is substantially identical with an outer diameter of said fixing roller.

31. The printer apparatus as set forth in claim 3, wherein said pressurizing roller has an outer diameter of substantially 30 mm.

32. The printer apparatus as set forth in claim 3, wherein a surface layer of said pressurizing roller is harder than a surface layer of said fixing roller.

33. The printer apparatus as set forth in claim 2, wherein a hardness of a surface layer of said pressurizing roller is 20° to 60° in Asker C hardness.

34. A printer apparatus comprising:

(a) an image-forming unit for forming an image to be transferred onto a recording material; and (b) a fixing unit for fixing said image onto said recording material, said fixing unit including:

i) a heat-up roller;

ii) a heating section for heating said heat-up roller;

iii) a power supply section for supplying power to said heating section; and iv) a heat controller for controlling said power supply section;

wherein said heat controller is in contact with an inner circumferential surface of said heat-up roller, rotates together with said heat-up roller, and is thermally deformed at temperatures above a predetermined value and leaves said inner circumferential surface to interrupt power supply of said power supply section to said heating section.

35. The printer apparatus as set forth in claim 34, wherein said fixing unit has a rotating shaft that is coupled to a flange section rotating together with said heat-up roller, and said rotating shaft includes a ring-like electrode.

* * * * *